US007972029B2

(12) United States Patent
Pruss et al.

(10) Patent No.: US 7,972,029 B2
(45) Date of Patent: Jul. 5, 2011

(54) METHOD AND APPARATUS FOR CREATING HIGH EFFICIENCY EVEN INTENSITY CIRCULAR LIGHTING DISTRIBUTIONS

(76) Inventors: Mark Bryan Pruss, Coal City, IL (US); Patrick Jeffery Condon, Morris, IL (US)

( * ) Notice: Subject to any disclaimer, the term of this patent is extended or adjusted under 35 U.S.C. 154(b) by 229 days.

(21) Appl. No.: 12/204,227

(22) Filed: Sep. 4, 2008

(65) Prior Publication Data

US 2009/0059598 A1 Mar. 5, 2009

Related U.S. Application Data

(60) Provisional application No. 60/969,852, filed on Sep. 4, 2007.

(51) Int. Cl.
*F21V 5/00* (2006.01)
*F21V 7/00* (2006.01)

(52) U.S. Cl. ..... 362/245; 362/308; 362/327

(58) Field of Classification Search ..... 362/307, 362/308, 309, 327, 329, 335, 336, 338
See application file for complete search history.

(56) References Cited

U.S. PATENT DOCUMENTS 6,536,923 B1 * 3/2003 Merz ..... 362/336
7,347,603 B2 * 3/2008 Ikeda et al. ..... 362/327
7,488,089 B2 * 2/2009 Park et al. ..... 362/327

* cited by examiner

*Primary Examiner* — Y My Quach Lee
(74) *Attorney, Agent, or Firm* — Boyle Fredrickson, S.C.

(57) ABSTRACT

A surface mount LED lamp includes a central first section having a flat circular window that provides a direct view window to the source energy and having an angle equal to the total intended output viewing angle of the LED lamp thereby providing a smooth and relatively undistorted output intensity distribution. The window allows the energy from the wide angle LED source to exit the lamp with minimal distortion, creating a smooth generally cosine shaped light distribution through the intended viewing angle of the device. A second outer section has both refractive and internally reflective surfaces for the purpose of collecting the wider output angle light from the LED source thereby adding to the intensity at the outer edges of the distribution.

5 Claims, 9 Drawing Sheets

METHOD AND APPARATUS FOR CREATING HIGH EFFICIENCY EVEN INTENSITY CIRCULAR LIGHTING DISTRIBUTIONS

CROSS REFERENCE TO RELATED APPLICATION

The present application claims the benefit of U.S. Ser. No. 60/969,852, filed Sep. 4, 2007, the disclosure of which is incorporated herein by reference.

FIELD OF THE INVENTION

The present invention relates generally to the redistribution of radiant, particularly electromagnetic energy, for regulated lighting systems. More particularly, the invention is directed to the efficient distribution of light energy from a conical wide-angle light source into a substantially even intensity conical output distribution.

BACKGROUND OF THE INVENTION

There are many situations in which electromagnetic energy is to be distributed into an even intensity output requirement. In the vast majority of these situations, a high efficiency transfer of source energy is desirable. This is particularly true in regulated lighting. For example, home and office interior lighting, overland vehicle safety lighting, aircraft lighting, street lamp lighting, and marine lighting are examples that require specific light distribution patterns that are generally mandated by government regulations to have minimum and maximum illumination values. Similarly, corporations have mandated minimum illumination requirements for particular work surfaces. In both cases, a minimum photometric or radiometric output must be met by the illumination device. In many cases, the output distribution requirement consists of an even intensity in angled space or an even illumination projected onto a target surface.

For example, an amber P2 rated sidemarker clearance light requires an even minimum intensity of 0.62 Candellas (Cd) for 45 degrees in the horizontal plane and over 20 degrees in an orthogonal vertical plane as measured by a type A goniometer. For mounting purposes it is desirable to meet the requirement by using an even intensity conical distribution with an output measuring at least 45 degrees from the lamp's central axis.

In another example, for reading lamps, kitchen lamps, or room lighting it is often desirable to generate an even illumination for a conical area over angles ranging from 20 degrees to 70 degrees from the central axis of the lamp. In order to achieve a relatively even illumination, the intensity at the outer edge of the cone is generally higher than in the central axis of the cone to correct for the increased distance to a projection surface, which is typically perpendicular to the axis of the lamp.

Light Emitting Diodes (LEDs) are solid state electrical devices with high efficiencies and long lives. LEDs are generally impact resistant, use very little power and often have 100,000 hour life spans. These features make these devices preferable for use in safety lighting. The primary disadvantage of LED light sources however is their cost. If the efficiency of an optical device to distribute light from the LED into the required or regulated pattern is improved, fewer LEDs can be used resulting in more cost accessible interior illumination and safety lighting devices.

Recently, LED manufacturers have turned to surface mountable LED devices that have superior heat removal from the diode junction and higher optical flux per watt. These devices are now being regularly provided with a flat output surface free from the source distorting optics of past LEDs. These devices typically have very wide output distributions with typical viewing angles greater than 100 degrees. The viewing angle is typically defined as the full angular width of the optical distribution where the light output reaches 50% of the intensity measured on the optical axis. LEDs of this type have generally symmetrical outputs around the center or optical axis. Thus, a device having a viewing angle of 10 degrees describes a conical output distribution where 50% of the peak intensity value occurs at 5 degrees from the optical or center axis of the device. A 120 degree viewing angle device, which is a very common wide output angle LED, defines a device which has an output intensity of 50% at an angle of 60 degrees from the optical axis.

The increased availability of high output LEDs with hemispherical output and intensity closely following that of a Lambertian plane emitter has provided a unique opportunity for the development of new optical lens shapes for meeting government requirements. These LEDs output a highly diffused illumination pattern with a very predictable intensity distribution closely following the trigonometric cosine function. However, a Lambertian LED emitter drops to about 70% of its peak on-axis intensity at 45 degrees. As such, to meet even illumination requirements, 30% more energy must be used.

For interior lighting applications in particular, a smooth output distribution with minimal hot spots or artifacts is aesthetically necessary. Multi-faceted fresnel type optics become impractical for this application as inconsistencies in tooling and manufacturing invariably result in artifacts in the light distribution.

Diffusing lenses have been developed to address some the aforementioned drawbacks of conventional lighting systems. Generally, these lenses reflect over half of the light energy back in the direction of the source preventing it from exiting the lamp. Other energy is often absorbed in the devices themselves. The result is a dramatic increase in the energy source requirement needed to meet specific output distributions. Moreover, higher cost, higher power consumption, and greater package heating also can occur. Thus, these conventional diffusing lenses are generally considered highly inefficient.

Other proposed solutions include lenses with minimal curvature or by employing no lenses at all. In each of these options up to 30% more source energy is required to meet minimum brightness levels adding to overall product cost, increased power consumption, and increased package heating.

It is also worth noting that in the case of LED devices, the diode chip which provides the illumination must be kept to a minimum temperature. Higher LED temperature results in reduced product life and can change the output color and intensity of the LED. Thus, there remains a need for a cost-affordable lamp using one or more LEDs to provide a substantially even intensity conical output distribution.

SUMMARY OF THE INVENTION

The present invention is directed to a surface mount LED lamp that overcomes the aforementioned drawbacks. The LED lamp includes a central first section that includes a flat circular window providing a direct view window to the source energy having an angle equal to the total intended output viewing angle of the LED lamp thereby providing a smooth and relatively undistorted output intensity distribution. This window allows the energy from the wide angle LED source to exit the lamp with minimal distortion, creating a smooth generally cosine shaped light distribution through the intended viewing angle of the device. A second outer section has both refractive and internally reflective surfaces for the purpose of collecting the wider output angle light from the LED source, thereby adding to the intensity at the outer edges of the distribution.

In practice, the central window of the first section allows the energy from the wide angle LED source to exit the lamp with minimal distortion, creating a smooth generally cosine shaped light distribution through the intended viewing angle of the device. For instance, if the device were intended to project an even cone of light over a viewing angle of 90 degrees, the central window could be designed such that the light from the LED source would be allowed to exit this window with a viewing angle of 90 degrees. Used alone this could result in a projected cone of light which was 29% less bright at the outer edge. The second section collects the energy from the outer angles of the source and directs the light inward adding the light energy to the outer edges of the narrower output angle requirement thereby evening out the intensity distribution.

It is therefore an object of the present invention to provide an improved non-imaging optical lens apparatus for the creation of even illumination conical output patterns with a width greater than 30 degrees from the optical axis of the lamp.

It is a further object of the present invention to provide a higher efficiency and lower cost approach to the design of circular projected output, even illumination surface lighting.

It is yet a further object of the present invention to provide vehicle lights such as overland vehicle identification lamps, side marker lamps and clearance lamps that are efficient and cost effective.

DETAILED DESCRIPTION

As will be described herein, the present invention relates to an improved light pattern generating method and devices and lenses made therefrom. The lenses and devices have wide ranging uses in various applications including portable lamps and specialty lighting, homes, offices, over-land vehicles, watercraft, aircraft and manned spacecraft, automobiles, trucks, boats, ships, buses, vans, recreational vehicles, bicycles, motorcycles, mopeds, motorized cars, electric cars, airplanes, helicopters, space stations, shuttlecraft and the like.

Figure 13:
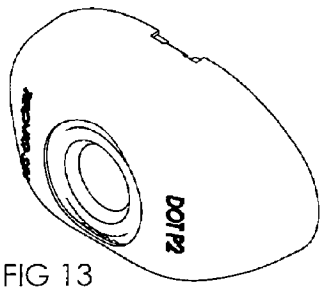
FIG. 13 is a perspective view of a sidemarker clearance lamp in accordance with another embodiment of the present invention.
Figure 11:
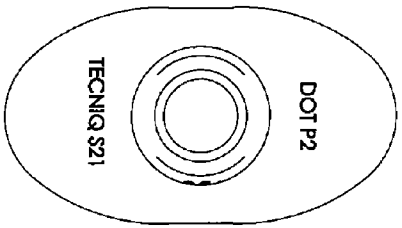
FIG. 11 is a front view of a sidemarker light in accordance with one embodiment of the present invention.
Figure 12:
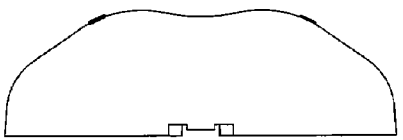
FIG. 12 is a side view of a sidemarker clearance lamp in accordance with one embodiment of the present invention.

FIGS. 1-4, FIGS. 11-13, and FIGS. 21-25 show three embodiments of devices incorporating the present invention. FIGS. 1-4 show an interior lamp and lens with multiple LED sources where the lens is configured to project a light cone designed to illuminate a surface evenly. FIGS. 11-13 show a single LED sidemarker clearance lamp. FIGS. 21-25 show a single LED miniature sidemarker red or amber LED behind a lens.

Figure 1:
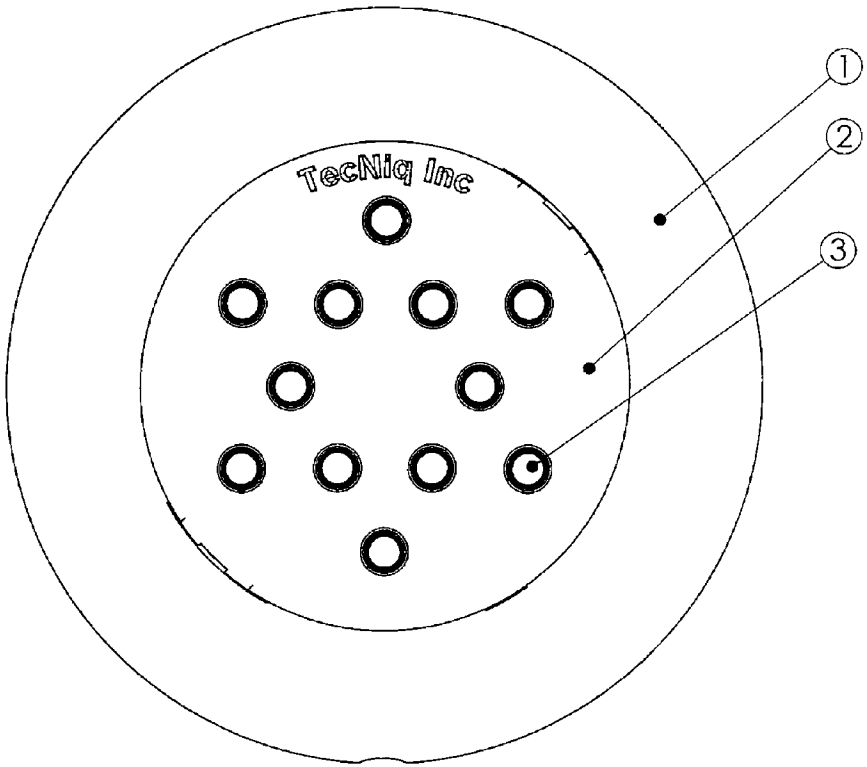
FIG. 1 is a front view of a low profile LED interior lamp in accordance with one embodiment of the present invention.
Figure 3:
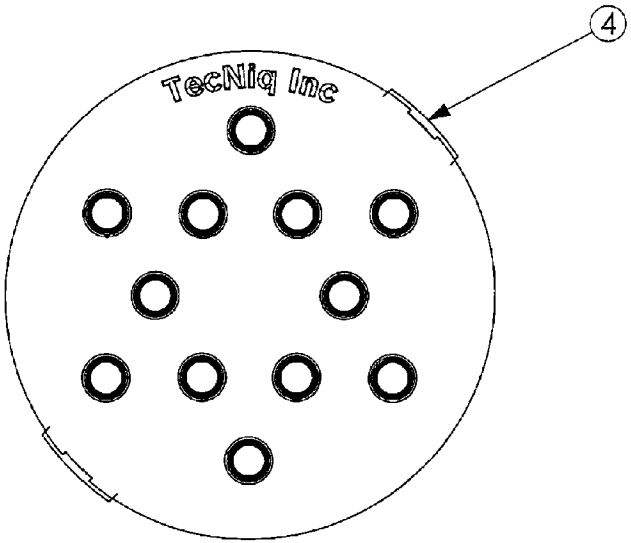
FIG. 3 is a front view of a lens for the low profile LED interior lamp in accordance with one embodiment of the present invention.

Referring now to FIG. 1, the lamp assembly includes a metal stamping 1 into which a lens assembly 2 is snapped in place using retaining snap features 4, FIG. 3. Each of the LED sources is placed behind an individual revolved optic 3, which will be described in greater detail herein.

Figure 2:
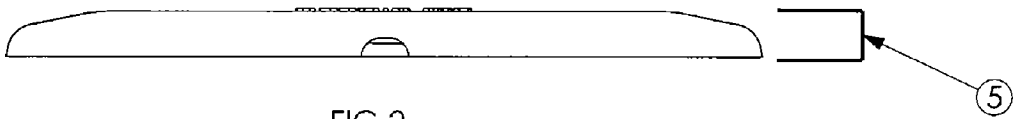
FIG. 2 is an edge view of a low profile LED interior lamp in accordance with the present invention.
Figure 4:
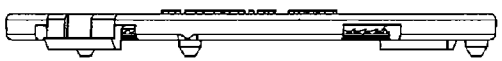
FIG. 4 is an edge view of a lens for the low profile LED interior lamp in accordance with one embodiment of the present invention.

FIG. 2 is an edge view of the assembly shown in FIG. 1 where the thinness of the device can be seen. FIG. 4 depicts an edge view of the lens of FIG. 3 illustrating the overall lens thickness 5.

Figure 5:
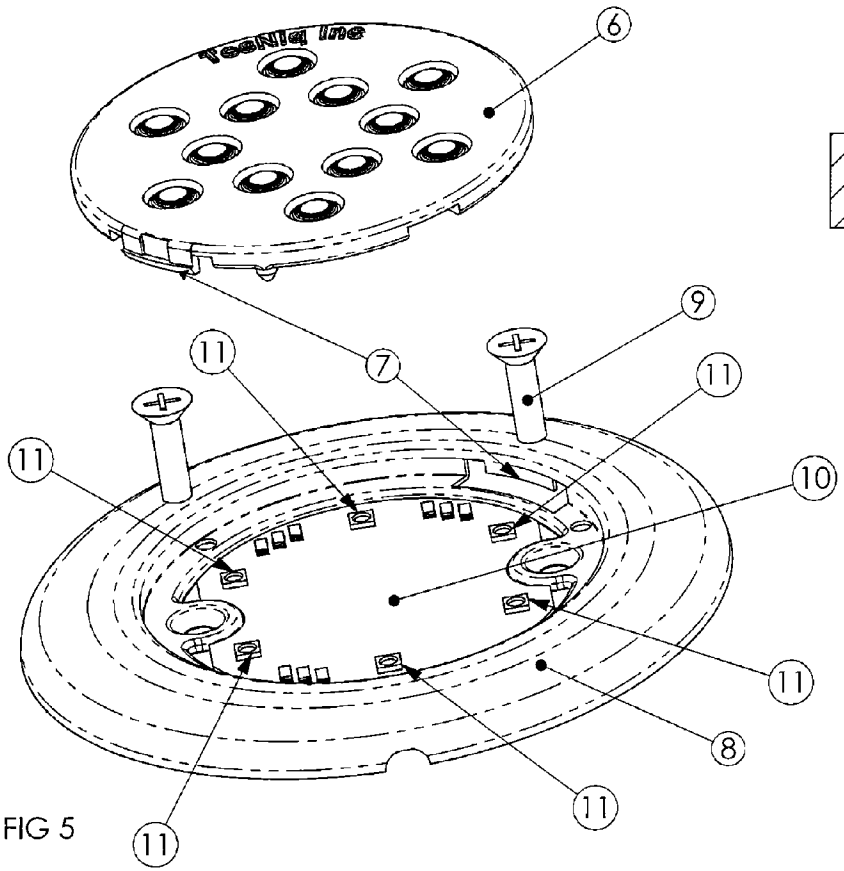
FIG. 5 is an exploded view of a low profile LED interior lamp in accordance with one embodiment of the present invention.

FIG. 5 is an exploded view of the interior lamp shown in FIGS. 1-4 with the lens 6 containing the individual optical elements removed. When assembled snap features 7 hold the light to the stainless steel base 8 hiding the mounting screws 9 from view. A printed circuit board 10 is mounted using double sided adhesive tape, for example, to the stainless steel base 8, which in the illustrated embodiment is ring shaped and which also acts as a heat removal device. In this embodiment LEDs 11 are shown mounted on the top of the PCB 10 such that they align with the individual optical elements in the lens 6. The close proximity of the LEDs 11 on the PCB and the soldered PCB vias allow efficient transfer of heat from the LED to the metal trim ring 8, thereby allowing the LEDs to operate within a desired temperature range.

Figure 6:
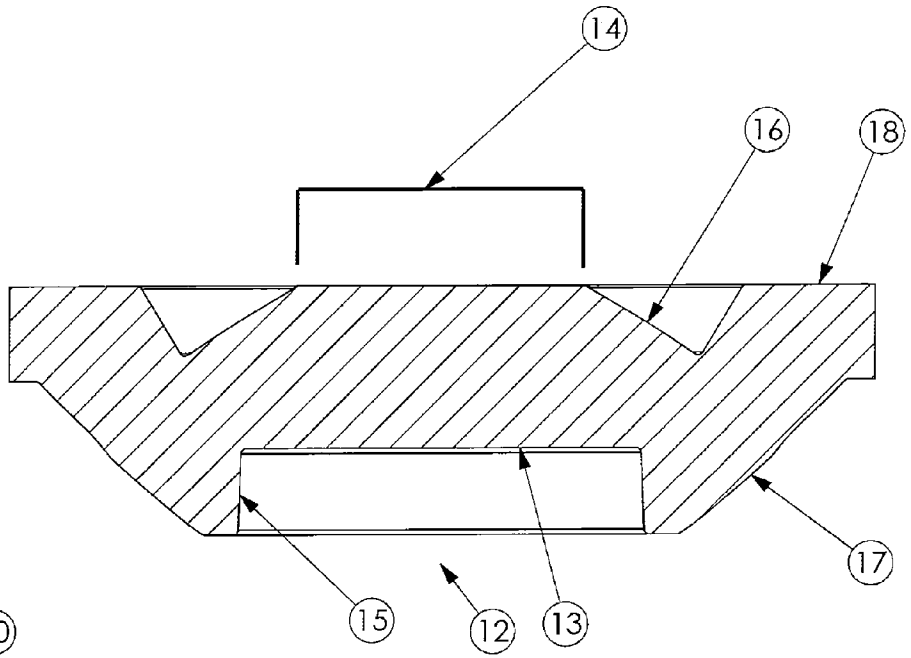
FIG. 6 is a section view of a single lens element from a low profile interior lamp in accordance with one embodiment of the present invention.

FIG. 6 depicts a cross-sectional view of a single optical element from the lens 6 of FIG. 4. For illustrative purposes the light from the LED is defined to emit from focal point 12 in a hemispherical pattern directed toward surfaces 13 and 15. In the case of surface 13 the light enters the material compressing the waveform according to Snells law. The flat nature of the surface allows the beam to compress with minimal distortion of the beam intensity gradient. The central portion of the beam strikes outer surface 14 which is also flat and parallel to inner surface 13 the light beam re-expands to its original angular width according to the Snells law of refraction and exits the material with minimal losses due to surface reflection and minimal distortion. The result is the projection of a section of the original Lambertian waveform from the LED source. The conical viewing angle emitted from surface 14 covers the complete output viewing angle of the device.

Surface 16 refracts the light that would have otherwise fallen outside of the intended output cone back into the lower intensity outer edges of the cone. Surface 15 is oriented vertically to efficiently collect the highest output angle light from the LED. The light from surface 15 travels through the lens material and strikes surface 17 at an angle of incidence greater than the critical angle for the material and reflects upward to refract out of the lens material at surface 18, filling in the lower intensity edges of the intended output cone.

Figure 7:
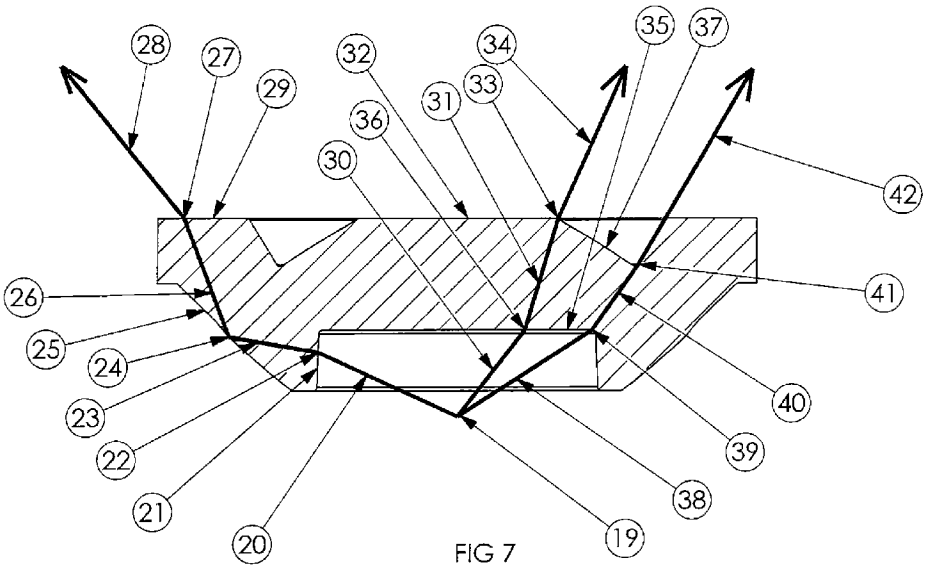
FIG. 7 is a section view depicting light rays passing through a single lens element from a low profile interior lamp in accordance with one embodiment of the present invention.

FIG. 7 is a cross-section view of a representative optical element of FIG. 4 showing the paths of light rays as they emit from a focal point through the lens material into the output cone. Light emitting from a wide angle LED source can be approximated as coming from a focal point 19 and emitting hemispherically with an intensity distribution following the cosine of the angle between the optical axis and the viewing direction. In FIG. 7 ray 20 emits from focal point 19 toward surface 21 striking the surface 21 at point 22. The light refracts into the material along ray 23 toward surface 25 striking at point 24 at an angle of incidence greater than the critical angle for the material. The light ray 23 internally then reflects along path 26 toward surface 29 striking at point 27 and refracting out of the material along path 28. A second ray 30 emits from point 19 and strikes the flat surface 35 at point 36 refracting into the lens material along ray 31. The light continues inside the material and strikes surface 32 at point 33, which is nearly at the corner between surface 37 and 32, refracting out of the material at the outer edge of the intended output cone along path 34. A third ray is 38 is shown emitting from surface 19 striking surface 35 at point 39 refracting into the material along path 40 thereby striking surface 37 and refracting out of the lens material along path 42 to the outer edge of the output cone.

Figure 8:
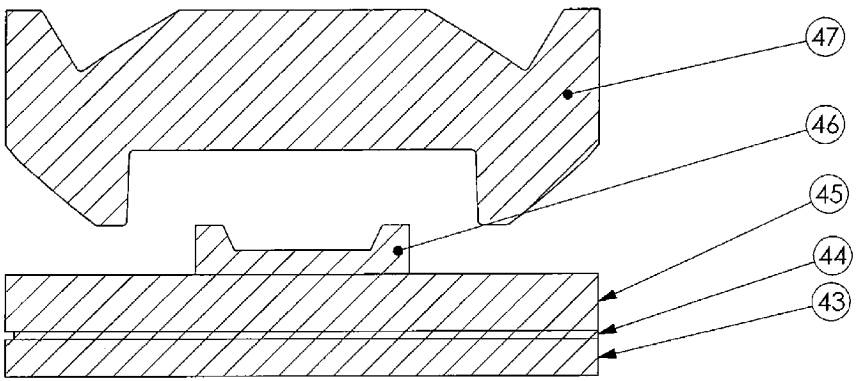
FIG. 8 is a section view of a low profile interior lamp assembly in accordance with one embodiment of the present invention.

FIG. 8 is a cross-sectional view of the lamp assembly. Stainless steel base 43 acts as trim ring and heat sink for PCB 45. The PCB 45 is bonded to the heat sink 43 using a thin layer of double stick pressure sensitive adhesive 44 or a similar adhesive which is sufficiently thin to minimize heat resistance from the LED 46 to the stainless steel base 43. Transparent polycarbonate lens 47 is aligned over LED 46 to capture and direct light into the intended output viewing angle.

Figure 9:
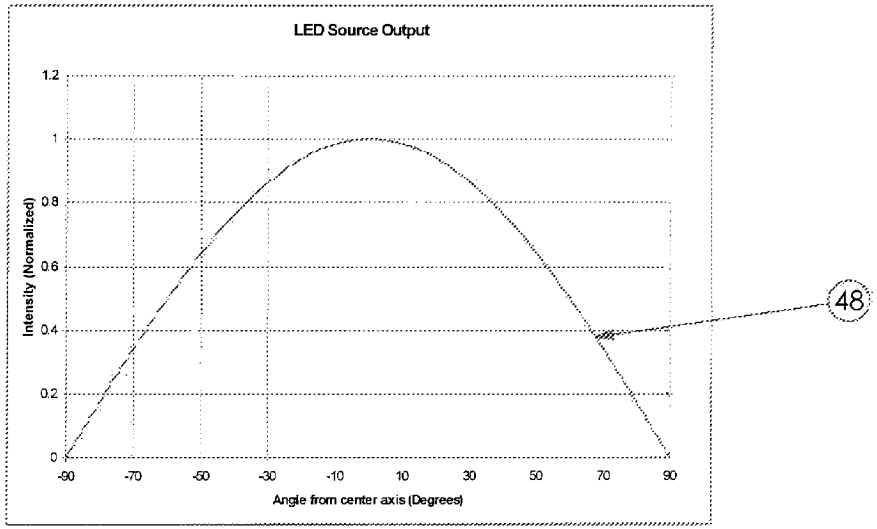
FIG. 9 is a graph of a typical wide output Lambertian LED source.

FIG. 9 is a graph of the output intensity of a typical wide output angle LED with no secondary optics as viewed at an angle to the optical axis from −90 to 90 degrees on the horizontal axis of the graph. The intensity curve 48 follows the cosine of the angle from the center optical axis to the output angle from the center axis. This curve 48 is equivalent to a Lambertian planar source as known in the art.

Figure 10:
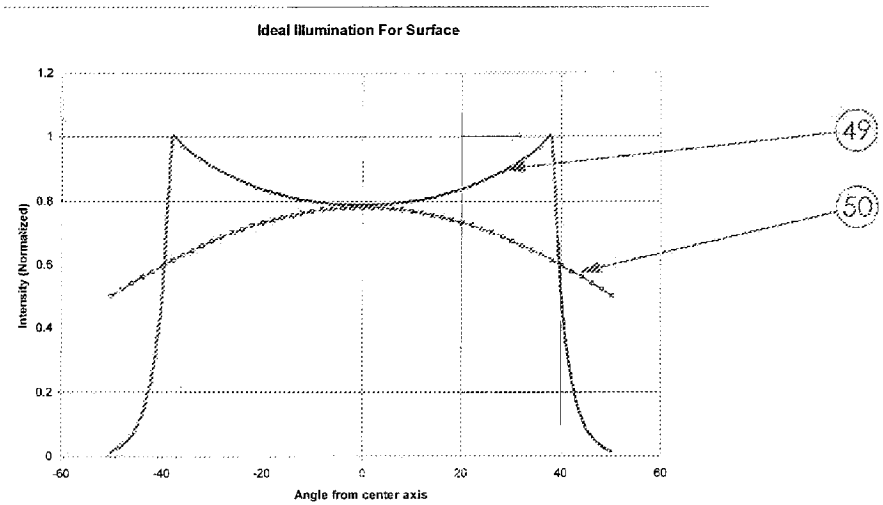
FIG. 10 is a graph of the ideal output of a uniform surface illuminator overlaid on a graph of a typical wide output Lambertian LED source.

FIG. 10 is a graph of the ideal output intensity curve 49 for even surface illumination overlaid on the output intensity curve 50 of a typical wide output angle LED. The graph is truncated from +60 to −60 degrees off of the optical axis to represent the required illumination area.

FIG. 11 is a front view of a United States P2 rated sidemarker lamp 120 designed to meet U.S. Federal Motor Safety Standard 108.

FIG. 12 is a side view of a United States P2 rated sidemarker lamp 120 designed to meet U.S. Federal Motor Safety Standard 108.

FIG. 13 is a perspective view of a United States P2 rated sidemarker 120 lamp designed to meet U.S. Federal Motor Safety Standard 108.

Figure 14:
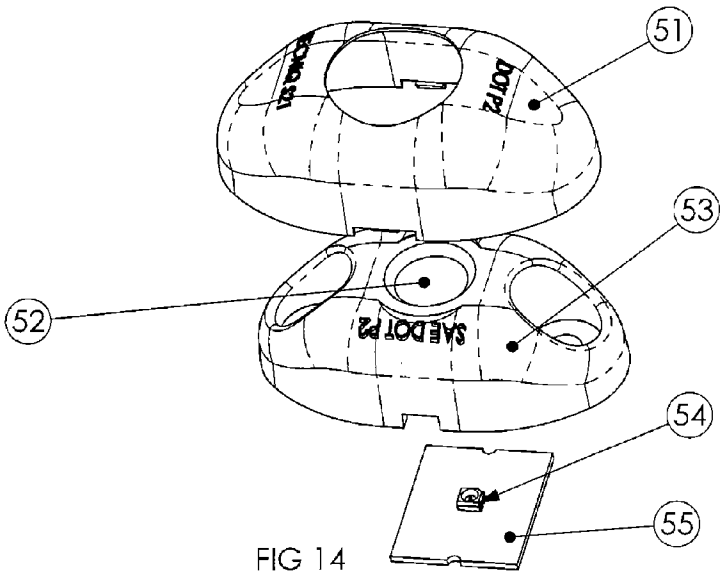
FIG. 14 is an exploded view of the sidemarker lamp of FIG. 11.

FIG. 14 is an exploded view of the P2 rated sidemarker lamp of FIGS. 11-13 made in accordance with one embodiment of the present invention. Stainless steel body 51 snaps on to polycarbonate lens body 53 optical lens element 52 is oriented in the center of the lens body 51. The lens element converts the Lambertian intensity distribution of LED 54 into an even intensity cone having a half angle of approximately 50 degrees from the central optical axis. The PCB 55 is designed to hold and orient LED 54 directly beneath the lens element 52. The PCB also functions as the transport for electricity to the LED and conducts heat away from the LED 54.

Figure 15:
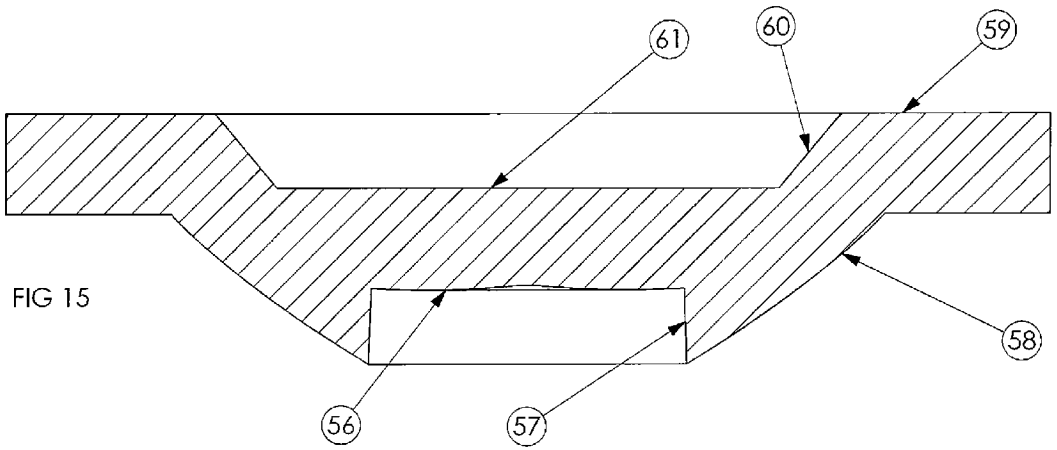
FIG. 15 is a section view of the sidemarker clearance lamp lens in accordance with another embodiment of the present invention.
Figure 16:
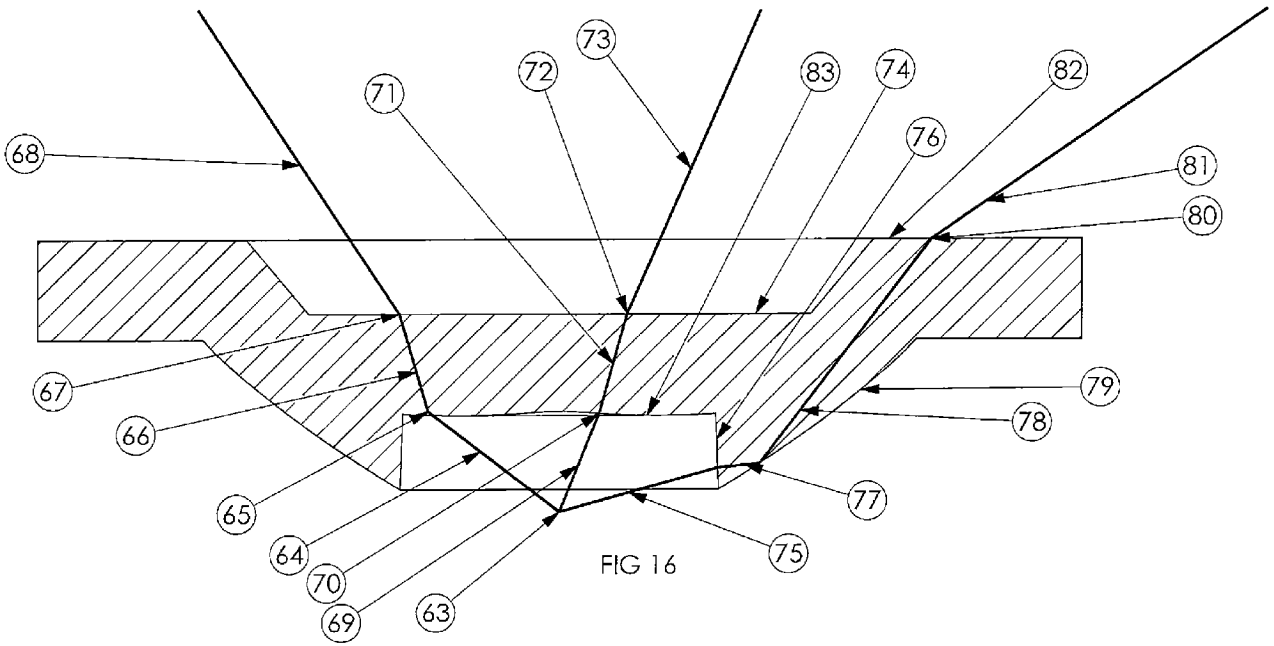
FIG. 16 is a section view of the sidemarker clearance lamp lens depicting three separate light rays passing through the optic.

FIG. 15 is a cross-sectional view of the lens of the P2 rated sidemarker lamp. Surface 56 is a non-flat surface which has a reduced radius of curvature designed to direct the light from focal point 63 into the lens material with minimal changes to the original LED intensity, as shown in FIG. 16. The light from surface 56 passes through the transparent lens material to strike outer lens surface 61 where it refracts into the full width of the intended output pattern. Surface 60 is angled such that minimal light intersects the surface. Surface 57 is angled such that light outside of the easily collected central portion of the LED output cone is directed into the lens material with minimal losses. The light intersects surface 58 at an angle greater than the critical angle for the material and reflects toward surface 59 where it refracts out of the lens material into the intended output distribution.

FIG. 16 is another cross-sectional view of the P2 rated sidemarker lamp. Three light rays are shown emitting from the focal point of an LED light source and passing through the various surfaces into the intended output distribution. Light ray 64 emits from point 63 toward surface 83 where it strikes at point 65 and refracts along ray 66 toward point 67 refracting into pattern along 68. Ray 69 emits from point 63 toward surface 83 striking at point 70 and refracting along ray 71 which passes through the material striking surface 74 at point 72 refracting along path 73. Ray 75 emits from point 63 and is directed toward surface 76 where it is refracted along path 77 and strikes surface 79 at an angle greater than the critical angle for the material causing total internal reflection of the light along path 78. The ray 78 strikes outer surface 82 at point 80 and refracts to the outer edge of the intended output distribution along path 81.

Figure 17:
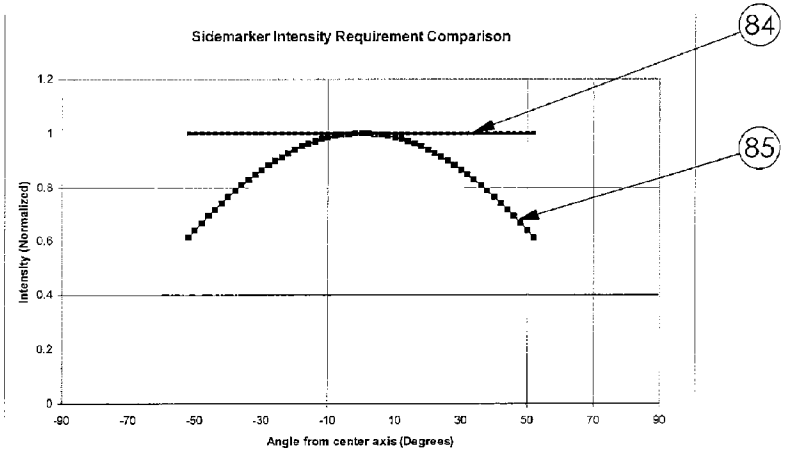
FIG. 17 is an intensity graph depicting the required even intensity output of a sidemarker lamp compared to the output of a typical wide output angle Lambertian LED source.

FIG. 17 is a graph of the predicted output 84 of P2 rated sidemarker lamp overlaid on the typical output of a wide angle Lambertian LED 85. The angle from the center axis is shown in degrees and the intensity of the graph is normalized to 1. The LED energy at the 50 degree edges of the requirement has dropped off to nearly 60% of the required output. To meet the specification using the LED without a lens, the intensity at the center would therefore need to exceed the specification by 1.55 times to meet the minimum requirement at the outer 50 degree edge of the output cone.

Figure 18:
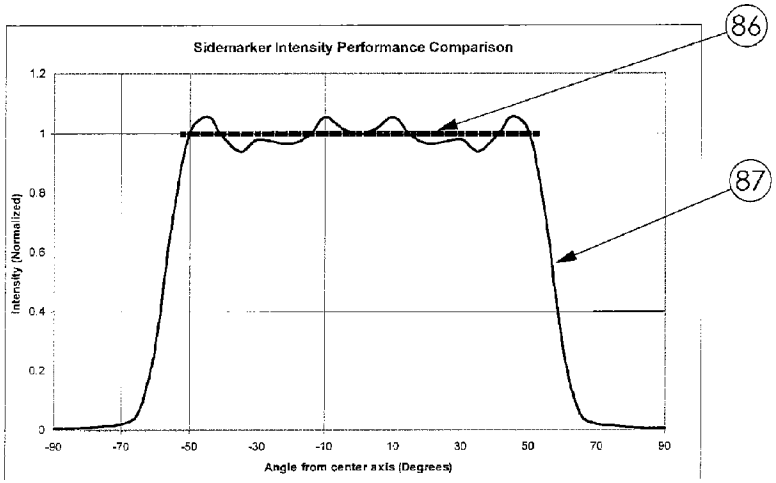
FIG. 18 is an intensity graph depicting the predicted output of the sidemarker lamp lens of FIG. 14.

FIG. 18 is a graph comparing normalized intensity to the angle from the center axis for the P2 rated sidemarker lamp relative to a required performance metric. Curve 86 represents the requirement and curve 87 is the predicted output from a computerized ray trace of the LED source through the lens.

Figure 19:
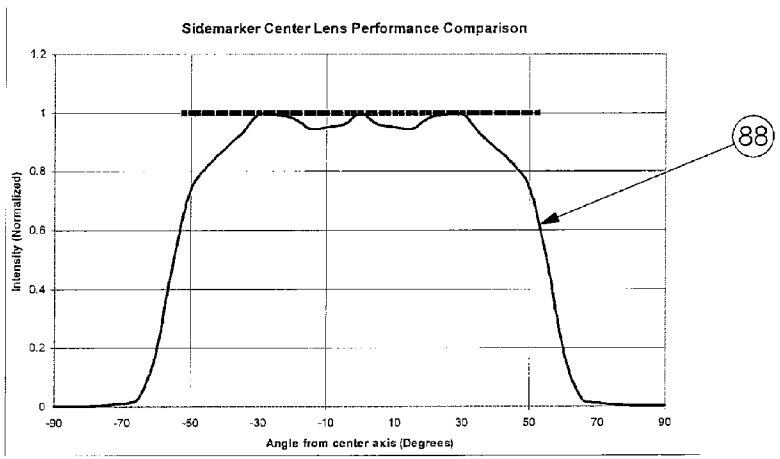
FIG. 19 is an intensity graph depicting the predicted output of the central portion of the lens element of the sidemarker lamp lens of FIG. 14.

FIG. 19 is a graph of the output from central refractive surface 83 of the lens of FIG. 15 and FIG. 16 showing the light cone output 88 which fits the full width of the intensity requirement from −50 to +50 degrees. The intensity at the 50 degree edges is visibly low compared to the requirement.

Figure 20:
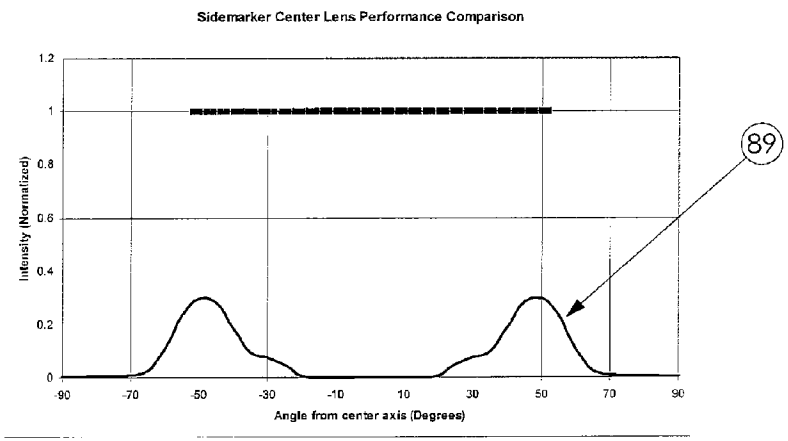
FIG. 20 is an intensity graph depicting the predicted output of the reflective portion of the lens element of the sidemarker lamp lens of FIG. 14.

FIG. 20 is a graph of the output from reflective surface 79 of the lens of FIG. 15 and FIG. 16 depicting the intensity required to fill in the edges of the curve 88 of FIG. 19. The addition of curves 88 and 89 results in the even output distribution 87 of the lens, as shown by the graph of FIG. 18.

Figure 21:
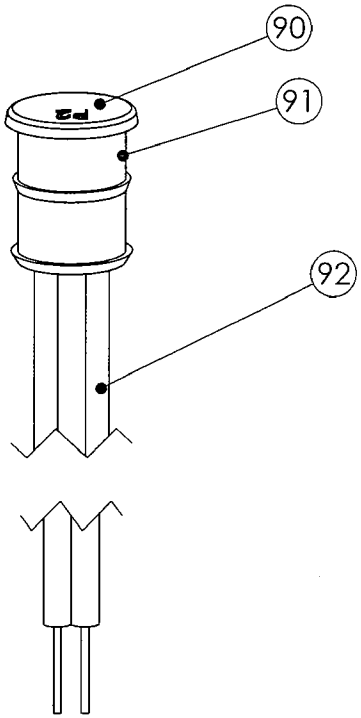
FIG. 21 is an assembly view of a mini-sidemarker clearance light in accordance with another embodiment of the present invention.

FIG. 21 is a perspective view of a mini-sidemarker 122 which meets the P2 requirement of the U.S. Federal Motor Vehicle Safety Standard 108. The lamp body 91 is of single piece construction and incorporates a lens under surface 90. Wires 92 bring power to the device.

Figure 22:
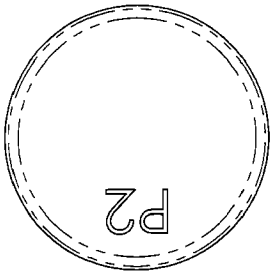
FIG. 22 is a top view of the lens portion of the mini-sidemarker clearance light of FIG. 21.

FIG. 22 is a top view of the mini-sidemarker 122 shown in FIG. 21.

Figure 23:
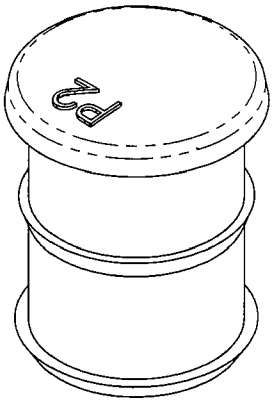
FIG. 23 is a perspective view of the lens portion of the mini-sidemarker clearance light of FIG. 21.

FIG. 23 is a side view of the mini-sidemarker 122 shown in FIGS. 21-22.

Figure 24:
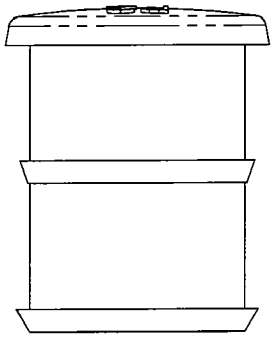
FIG. 24 is a side view of the lens portion of the mini-sidemarker clearance light of FIG. 21.

FIG. 24 is a section view of the mini-sidemarker 122 shown in FIGS. 21-23. As shown, the lens features 93 are an integral part of the lamp body.

Figure 25:
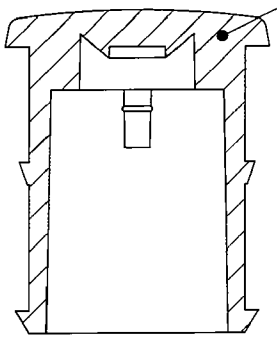
FIG. 25 is a section view of the lens portion of the mini-sidemarker clearance light of FIG. 21.

FIG. 25 is a section view of the mini-sidemarker of FIGS. 21-24 and FIG. 26 is a section view similar to FIG. 25 depicting rays passing from a focal point through the various lens surfaces. Light ray 95 projects from point 94 toward surface 100 striking at point 96 and refracting into the material along ray 97. Ray 97 strikes surface 101 at point 98 and refracts along beam path 99 into the output cone. A second ray 102 also projects from point 94 toward surface 103 striking near the intersection of surfaces 100 and 103 and refracting into the lens material toward 107 where it strikes the material at an angle greater than the critical angle for the material and reflects. The reflected ray 108 travels to point 109 where it refracts out of the outer surface along path 110 into the output distribution. A third ray 104 projects from a point 94 toward surface 103 striking at point 105 and refracting into the lens material. The ray 104 intersects surface 100 at an angle greater than the angle of incidence for the material and reflects along ray 111. The ray 111 intersects surface 101 at a point 112 and refracts out of the material along path 113 into the output cone.

Figure 27:
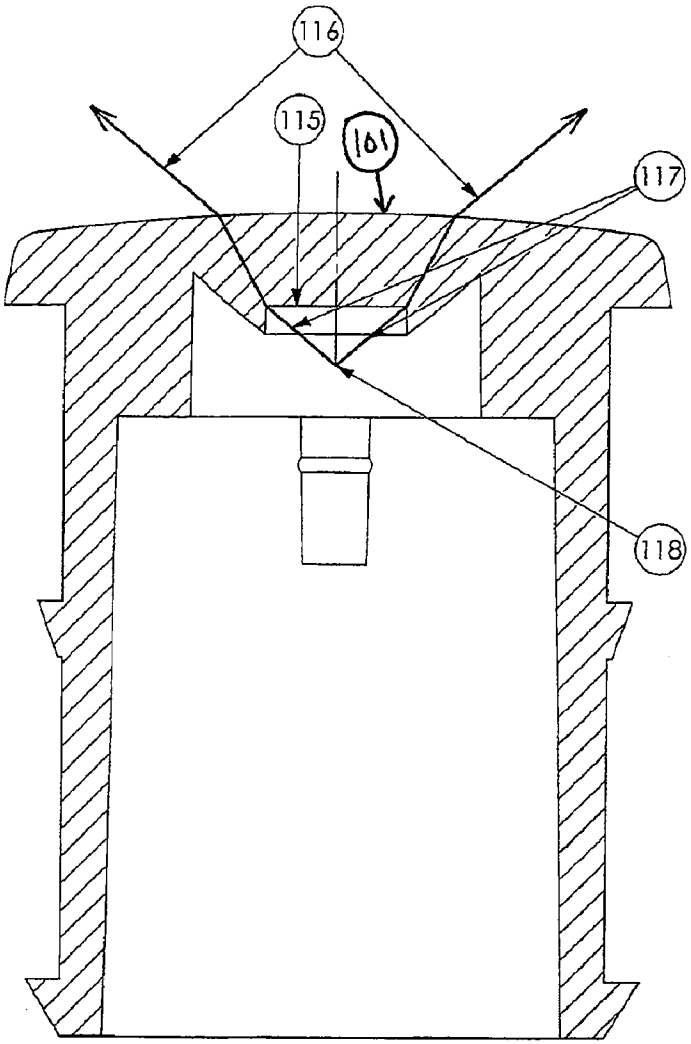
FIG. 27 is a section view of the lens portion of the mini-sidemarker clearance light of FIG. 21 depicting multiple light ray paths passing through various lens elements.
Figure 26:
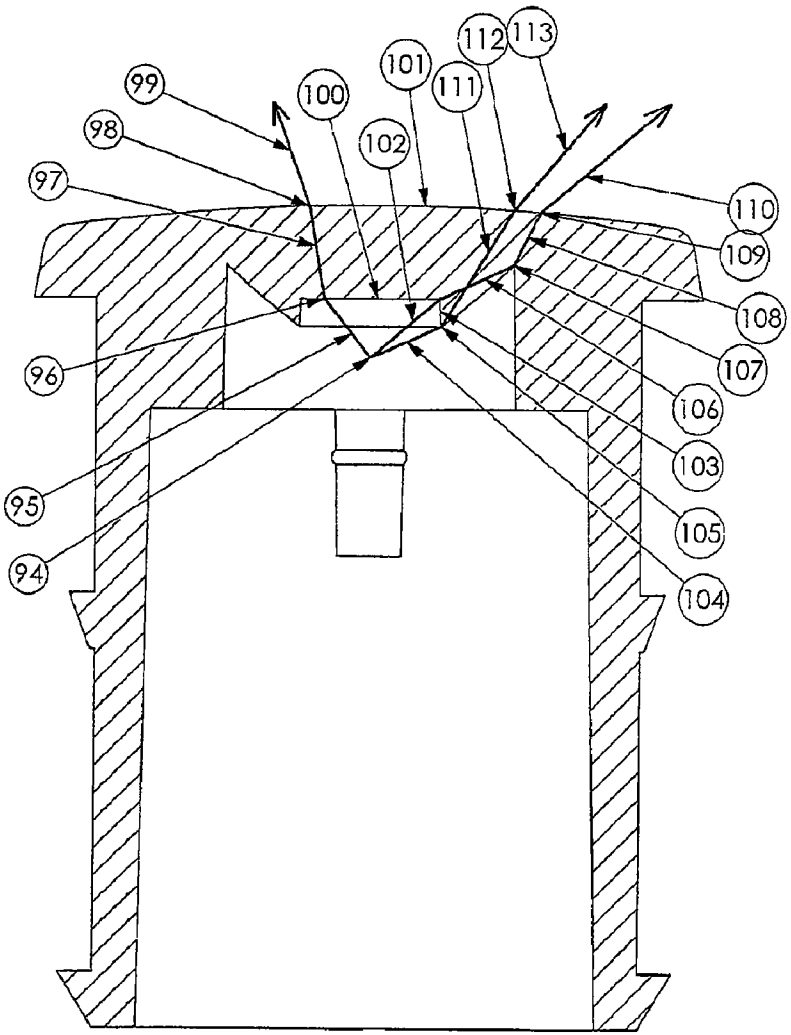
FIG. 26 is a section view of the lens portion of the mini-sidemarker clearance light of FIG. 21 depicting multiple light ray paths passing through various lens elements.

FIG. 27 is the same cross section view of FIG. 26 depicting two edge rays 117 passing through the refractive portion of the lens 115 and striking the outer surface of the lens. The rays 117 refract through the outer surface 101 into rays 116 that define the full width of the intended output distribution as illustrated in FIG. 27.

It will be appreciated that the present invention provides an energy efficient method for distributing a wide output diffuse source of electromagnetic radiation (light) into a pre-determined circular requirement. Wide output light distributions can be generated from nearly any source including but not limited to incandescent lamps, LEDs, arc and gas discharge lamps.

In one embodiment, light from a wide output angle source such as an LED or incandescent lamp is directed onto a plurality of inner optical surfaces. These inner optical surfaces are comprised of multiple refractive and reflective surfaces revolved about an axis. The resulting light collection lens has a circular curvature when sectioned by any plane intersecting the optic perpendicular to the axis of revolution. The light from the collection lens is directed with high efficiency into the transparent lens material. The angular limits of the majority of the energy inside the lens material will typically be comprised of a conical waveform that is less than 60 degrees in width.

A device in accordance with the present invention will cause this beam to impinge on a second rotationally symmetric outer surface such that the outer surface will distribute the energy using the laws of refraction and reflection in at least the major axis to generate the required output.

The reflective surfaces may be created using internal reflection or a mirrored coating to cause the light to reflect off of a desired surface rather than passing through the surface in refraction. Internal reflection occurs when electromagnetic energy or light strikes a surface at an angle greater than the critical angle of the material resulting in a lossless reflection of 100% of the light energy.

In order to create a device or lens of the present invention, it is preferred to first determine the parameters of the device, including the requirement and intensity to be projected and the light source to be used. Once these parameters are ascertained, an appropriate optic can be shaped by a wide variety of computerized software lens optimization algorithms or spreadsheet based techniques.

The present invention may also be applicable for interior lighting systems. For such systems, it is generally desirable to have an even surface illumination over a predetermined area. While conventional LEDs may provide a consistent output distribution with minimal intensity gradient, they are nearly universally offered in an un-lensed source configuration. Typically these devices project a 180 degree hemispherical Lambertian output distribution with intensity dropping off gradually as a function of the cosine of the angle from the source central optical axis. This wide distribution is less than ideal for many applications in that the highest angle light is directed into walls and mounting hardware producing less than optimal illumination of the intended surface. In these applications it is most efficient to create a narrowed cone angle utilizing the maximum amount of LED energy with a minimum intensity or illumination gradient in the output pattern.

By creating a central refractive optic which provides minimal interference with the LED's existing output through the intended output cone angle, the majority of the lamps output intensity is created by direct viewing of the low intensity gradient source. At the edges of the intended cone, this portion of the optic invariably results in a weaker output distribution than at the center of the pattern. The benefit is that the output from this section creates a very smooth and aesthetically appealing transition from the high intensity center to the lower intensity edges. The gradual shift in intensity can be referred to as a low intensity gradient. By employing a minimal number of faceted optics to fill in the dimmer edges of the pattern, a highly even and efficient cone can be projected from a thin optical system.

The manufacturing of a lens in accordance with the present invention may be accomplished through a variety of processes including but not limited to injection molding, directly cutting the optic into transparent material and polishing the surface and other known and to-be-developed techniques. One preferred method for commercial production of such a device is injection molding because of the complex shapes of the lens. Further, the lens can be made of any material transparent to electromagnetic energy or light including but not limited to polycarbonate, acrylic, polystyrene, and glass.

A wide variety of computational algorithms in spreadsheets or software can be used to compute an appropriate surface shape for the lens. In using such algorithms, particular attention should be paid to the percent transmission of the light at higher angles of incidence to the surface normal and the output waveform distortion at high angles of incidence. The algorithms must also be constrained in an appropriate manner such that manufacturable surfaces are computed.

The angle of refraction of light through a surface is governed by Snells law. Snell's law gives the relationship between angles of incidence and refraction for a wave impinging on an interface between two media with different indices of refraction. Like any continuous mathematical function Snells law can be approximated by a linear function when considered over a sufficiently small angle.

LEDs as with all commercial electrical light sources generate heat. Although the LED efficiency is higher than many sources the heat generated must still be removed. Excess heat degrades the performance of the LED and shortens its lifespan. LED lamps must therefore be designed with proper heat sinking to maintain product performance and life. Accordingly, various heat sinking devices may be used, including printed circuit board PCB vias soldered full, heavy copper PCBs, thermally conductive potting materials, thermally conductive plastics, and metal heat sinks.

References to electromagnetic radiation or light in this application are intended as references to the entire electromagnetic spectrum, including the visible spectrum and all non-visible wavelengths including but not limited to infrared, ultraviolet, x-ray, gamma ray and microwave.

The present invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter disclosed herein.

We claim:

1. A surface mount lamp having an intended viewing angle, comprising:

a plurality of light sources, each of which emits light in a beam along a corresponding optical axis; and a lens assembly having a plurality of optical elements, each optical element revolved around a corresponding light source, each optic having a first substantially flat surface that compresses the beam emitted by a matched light source and a second substantially flat surface spaced from and parallel to the first substantially flat surface and that expands the light beam to its original angular width, wherein the expanded light beam is emitted from the optical element with a conical viewing angle that covers the intended viewing angle; and wherein each optical element further includes an outer surface revolved around the optical axis having at least one internal reflection surface that redistributes light emitted at angle greater than the intended viewing angle to create a substantially even intensity gradient output distribution of the light emitted from the optical element.

2. The lamp of claim 1 further comprising a metal stamping to which the lens is connected by at least one snap feature.

3. The lamp of claim 2 further comprising a printed circuit board affixed to the metal stamping and wherein the plurality of light sources include LEDs mounted to the printed circuit board.

4. The lamp of claim 2 wherein the metal stamping is made of stainless steel.

5. The lamp of claim 2 further comprising a mounting plate to which the light sources and the lens assembly are mounted, and wherein the mounting plate is adapted to be mounted to a vehicle.

* * * * *